US005964594A

United States Patent [19]

Saitoh et al.

[11] Patent Number: 5,964,594

[45] Date of Patent: Oct. 12, 1999

[54] ELECTRICAL CONNECTOR

[75] Inventors: Yukio Saitoh; Toru Shinozaki, both of Tokyo, Japan

[73] Assignee: DDK Ltd., Tokyo, Japan

[21] Appl. No.: 09/103,992

[22] Filed: Jun. 24, 1998

[30] Foreign Application Priority Data

Jun. 27, 1997 [JP] Japan ..... 9-187459

[51] Int. Cl.[6] ..... H01R 9/09

[52] U.S. Cl. ..... 439/74; 439/67

[58] Field of Search ..... 439/74, 67, 660

[56] References Cited

U.S. PATENT DOCUMENTS

| | | | |
|---|---|---|---|
| 5,735,709 | 4/1998 | Hashiguchi et al. | 439/67 |
| 5,766,023 | 6/1998 | Noschese et al. | 439/74 |
| 5,803,752 | 9/1998 | McHugh | 439/74 |

FOREIGN PATENT DOCUMENTS 1032062 2/1998 Japan .

*Primary Examiner*—Neil Abrams
*Assistant Examiner*—T C Patel
*Attorney, Agent, or Firm*—Baker & Botts, L.L.P.

[57] ABSTRACT

An electrical connector includes a plug connector and a receptacle connector to be fitted with each other. The plug connector includes a number of metal contact layers alternately formed on both sides of a flexible insulating plate, and a plug housing of an insulator for holding and fixing the insulating plate. Each of the metal contact layers has a contact portion and a tail portion, the former being thinner than the latter for maintaining the flexibility and electric conductivity of the former and maintaining the mechanical strength of the latter. The receptacle connector includes a receptacle housing of an insulator having a fitting groove into which the metal contact layers together with the insulating plate are inserted, and receptacle contacts made of worked elastic metal pieces mounted alternately on both sides of the fitting groove correspondingly to the metal contact layers of the plug connector. With such alternate arrangement of the metal contact layers or receptacle contacts, the spaced distances between the metal contact layers or receptacle contacts on one side are about twice the spaced distances between all the metal contact layers or the receptacle contacts.

5 Claims, 10 Drawing Sheets

ELECTRICAL CONNECTOR

BACKGROUND OF THE INVENTION

This invention relates to an electrical connector including a plug connector and a receptacle connector adapted to be fitted with each other for connection between electronic appliances, and more particularly to an electrical connector including a plug connector having plug contacts formed on a flexible insulating plate to accommodate any positional variance of the contacts when being connected to a mating connector.

The applicant of the present application has already proposed an electrical connector whose plug connector is provided with flexible contacts, for example, comprising FPC substrates (flexible printing card substrates) to accommodate positional variance between connectors in Japanese Patent Application No. H8-204,267(1996). However, the proposed electrical connector suffers the following several disadvantages to be eliminated from the contacts comprising a plurality of substrates, for example, two substrates bonded to each other.

(1) The contact is uniformly thin from its contact portion to its tail portion for the purpose of giving the flexibility to the contact. Consequently, the tail portion of the contact is likely to deform when being connected to a board, with resulting unreliable connection.

(2) The operation for bonding the FPC substrates is rather troublesome.

(3) There is a risk of the bonded surfaces of the FPC substrates being separated with elapse of time by repeated connection of the connectors.

(4) It can be expected to accommodate positional variance or shifting of the contacts effectively with the aid of their flexibility in all but longitudinal direction of the substrates. However, positional variance or shifting of the contacts in the longitudinal direction of the substrates could not be effectively accommodated.

(5) As the metal contact layers on one side of the bonded flexible substrates are aligned with the metal contact layers on the other side, the spacing distances between these metal contact layers and the spacing distances between contacts of a receptacle connector (mating connector) adapted to contact the metal contact layers could not be large enough.

(6) Moreover, in such an application requiring repeated heating processes such as soldering for connecting to a board of an electronic appliance through terminals of worked metal pieces connected to the tail portions of the contacts, the soldering operation could not be satisfactorily effected. Therefore, the uses of the electrical connector are limited.

The applicant of the present application has proposed in a Japanese Patent Application filed on Jan. 8, 1997 an electrical connector provided with a guard spacer along upper longitudinal edges of two FPC substrates to prevent the separation of their bonded surfaces.

SUMMARY OF THE INVENTION

It is an object of the invention to provide an electrical connector using flexible contacts in a plug connector and improved in several features to overcome the disadvantages of the prior art.

In order to accomplish this object, the electrical connector according to the invention includes a plug connector and a receptacle connector to be fitted with each other, said plug connector comprising a plug contacts formed on a flexible insulating plate, and a plug housing of an insulator for holding and fixing said plug contacts, each of said plug contacts comprising a contact portion provided on the side of the forward end of said insulating plate to be brought into contact with a contact of a mating connector, a fixing portion fixed to said plug housing, and a tail portion provided on the side of a fixing portion of said insulating plate to be connected to a board or the like, said receptacle connector comprising a receptacle housing of an insulator having a fitting groove into which the contact portions of the plug contacts are inserted, and receptacle contacts made of worked elastic metal pieces mounted in said fitting groove to be brought into contact with said contact portions of said plug contacts, and each of said contact portions of said plug contacts being formed by a thin metal layer for maintaining its flexibility and electric conductivity, and each of said tail portions of said plug contacts being formed by a metal piece thicker than its contact portion for maintaining its mechanical strength.

In a preferred embodiment, the thickness of the contact portions of the metal contact layers is thinner than that of the tail portions, the former being 0.03 to 0.07 mm and the latter being 0.1 to 0.2 mm. As a result, the contact portions of the metal contact layers will become more flexible and the tail portions will increase the mechanical strength.

Preferably, the metal contact layers are arranged such that the forward ends are slightly retracted from the forward end of the insulating plate, thereby ensuring the smooth insertion of the plug connector into the mating connector. The forward ends of the contact portions of the metal contact layers are preferably tapered or chamfered to obtain their smoother insertion and to prevent the separation of the forward ends from the substrate.

In another aspect of the invention, the plug contact comprises a number of metal contact layers arranged alternately on both the sides of the insulating plate such that the metal contact layers on one side of the insulating plate in a row in its longitudinal direction are located between the metal contact layers on the other side in a row in the longitudinal direction. Correspondingly to the metal contact layers of the plug connector, the contacts of the receptacle connector are mounted alternately on both sides of the fitting groove of the housing of the receptacle connector. Such an alternate arrangement of the metal contact layers and receptacle contacts creates an allowance for the spacing of the contact layers and contacts as described later.

In a further aspect of the invention, tail terminals made of worked elastic metal pieces press-fitted on both sides of the fitting groove of the receptacle housing so as to contact the tail portions of said metal contact layers, thereby enabling the tail terminals and the tail portions to be connected without using soldering.

The electrical connector according to the invention achieves the following significant effects. In order to facilitate the understanding, the following items include reference numerals used in the attached drawings.

(1) First, as the plug contacts of the plug connector comprises a single flexible plate, for example, FPC substrate according to the invention, the troublesome operation for bonding substrates is eliminated to obtain high productivity. Without bonded surfaces, the problem is naturally eliminated that bonded surfaces are separated over time by repeated connections and disconnections of a mating connector.

(2) According to the invention, the thicknesses of the contact portions 110*a* and tail portions 110*c* of the metal contact layers are different, thereby maintaining the flexibility of the contact portions 110*a* and increasing the thickness of the tail portions 110*c* so as to prevent their deformations to obtain reliable connection.

(3) According to the invention, the thickness of the contact portions 110*a* of the metal contact layers is 0.03 to 0.07 mm and the thickness of the tail portions 110*c* is 0.1 to 0.2 mm to increase the flexibility of the contact portions and reinforcing the tail portions so as to prevent their deformation when being connected.

(4) The contact portion 110*a* and the tail portion 110*c* of the metal contact layer are separately formed, or a separate member is added to the tail portion 110*c* to make thicker the tail portion than contact portion according to the invention. Thus, it is easily possible to make the contact portion of a higher conductive material and make the tail portion of a higher elastic modulus material and it is simply possible to reinforce the tail portion.

(5) Even if the contact portion 110*a* and the tail portion 110*c* of the metal contact layer are separately formed, they are easily connected by soldering or welding.

(6) The connected portions of the contact portion 110*a* and the tail portion 110*c* separately formed are reinforced by a molded resin according to the invention, thereby surely connecting them and preventing any damage of the connected portions when being connected to and disconnected from a mating connector.

(7) Owing to the flexibility of the plug contacts, they are somewhat rockable in all but longitudinal direction of the row of the metal contact layers to obtain effective accommodation of positional variance or shifting of the contacts.

(8) The metal contact layers of the plug connector are arranged alternately on both the sides of the insulating plate, and the receptacle contacts of the receptacle connector correspondingly arranged alternately on both sides of the fitting groove formed in the receptacle housing. With such an alternate arrangement, therefore, in comparison with the relatively small spaced distances (for example 0.4 mm pitch) between all the metal contact layers and between all the receptacle contacts, the spaced distances between the contact layers or contacts on same sides are about twice the above relatively small distances (for example 0.8 mm pitch). As a result, without enlarging the size of the electrical connector as a whole, it is possible to arrange a great number of wires in a wiring pattern (for example 240 cable conductors) in high density to provide a compact electrical connector.

(9) With the above alternate arrangement of the metal contact layers and receptacle contacts, the spaced distances between the metal contact layers on the same sides can be relatively large to provide the spatial allowance for accommodating positional variance or shifting (of the order of 0.2 mm in case of 0.8 mm pitch).

The same is true of the spaced distances between the receptacle contacts. In particular, as the contact portions formed by bents of worked elastic metal pieces of the adjacent receptacle contacts arranged on one side extend into interspaces between the two contact portions formed by bents of the receptacle contacts arranged on the other side, there is a risk of the adjacent contacts inadvertently contacting each other. However, such a risk is also effectively eliminated.

(10) In connecting the tail portions of the plug contacts to a board of an electronic appliance by using the tail terminals made of worked elastic metal pieces according to the invention, even if heating processes for soldering are repeated several times, there is no risk of solder flowing out, so that a wide variety of uses for the electrical connector according to the invention can be expectable.

The invention will be more fully understood by referring to the following detailed specification and claims taken in connection with the appended drawings.

DESCRIPTION OF THE PREFERRED EMBODIMENTS

FIGS. 1 to 10 illustrate, by way of example, an electrical connector including a plug connector and a receptacle connector according to the invention. While the electrical connector of the surface mounting type (SMT) will be illustrated and explained, this invention may also be applicable to electrical connectors of the straight dip type or L-shaped dip type.

Figure 4:
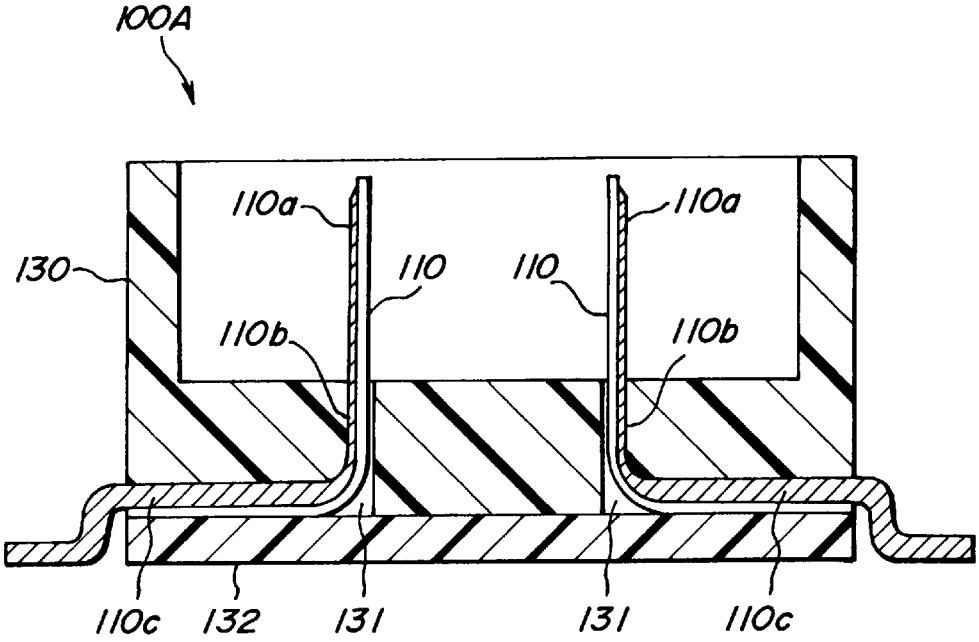
FIG. 4 is a cross-sectional view of the plug connector shown in FIG. 1.
Figure 6:
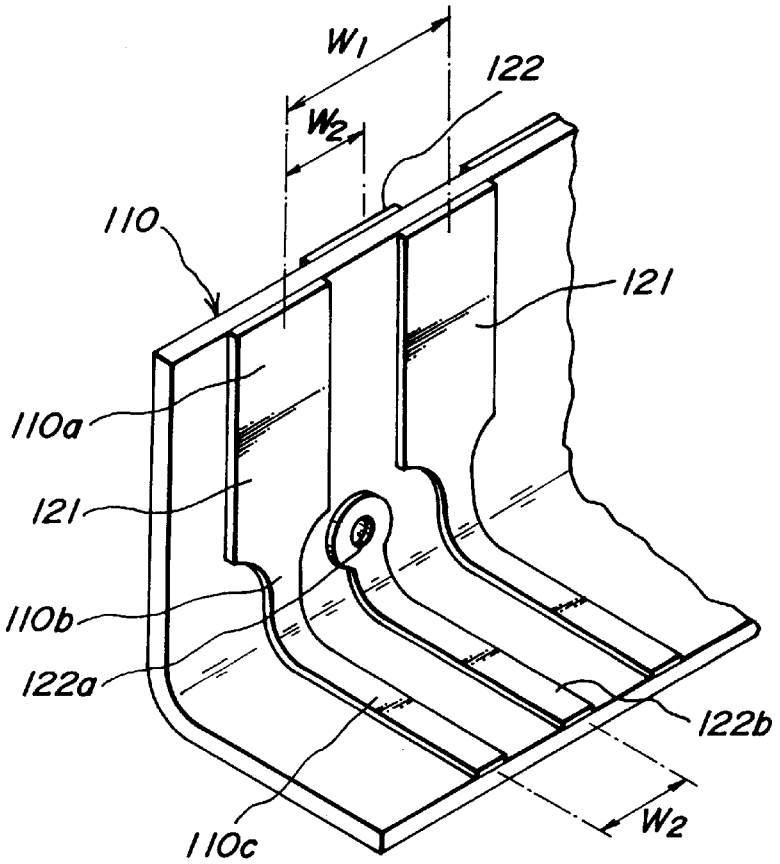
FIG. 6 is a partly enlarged perspective view of metal contact layers of the plug contact of the plug connector shown in FIG. 1.
Figure 7:
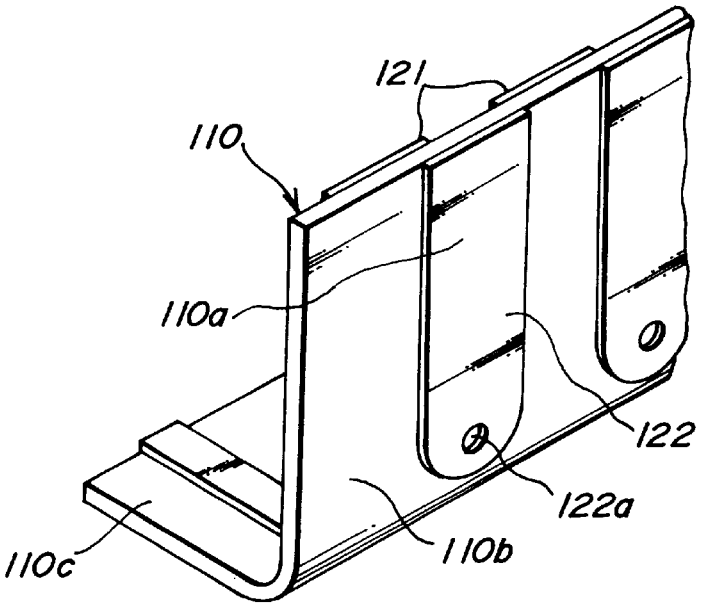
FIG. 7 is a partly enlarged perspective view showing the metal contact layers on the rear side of the plug contact shown in FIG. 5.

In the drawings, reference numerals 100A and 200 denote the plug connector and receptacle connector, respectively. The plug connector 100A includes plug contacts 110 each of which comprises a great number of metal contact layers 121 and 122 of copper foils formed on a single FPC substrate (flexible printing card substrate) which is somewhat flexible and having a substantially L-shaped cross-section as shown in FIGS. 4, 6 and 7. The metal contact layers 121 are formed in a row in the longitudinal direction of the substrate on one side thereof, and the metal contact layers 122 are formed in a row in the longitudinal direction of the substrate on the other side thereof. The metal contact layer 121 includes a contact portion (tip portion when being located in the connector) 110*a* and a tail portion (bottom portion) 110*c*.

The contact portion 110*a* of the metal contact layer 121 is effectively different in thickness from the tail portion 110*c*. In other words, the contact portion 110*a* is thinner than the tail portion 110*c*, maintaining the former flexible and increasing the strength of the latter to prevent its deformation when being connected to a board or the like.

Reference numeral 130 illustrates a plug housing made of an insulating material, which is a plastic molded body having a substantially U-shaped cross-section as shown in FIG. 4. In the shown embodiment, the bottom of the plug housing is formed with two slits 131 extending in its longitudinal direction for accommodating therein two plug contacts 110, respectively. The substrates of the plug contacts 110 have respective fixing portions 110*b* which are molded integral with the plug housing 130 to fix the plug contacts 110 to it. The bottom of the plug housing 130 is closed by a cover plate 132.

Figure 8:
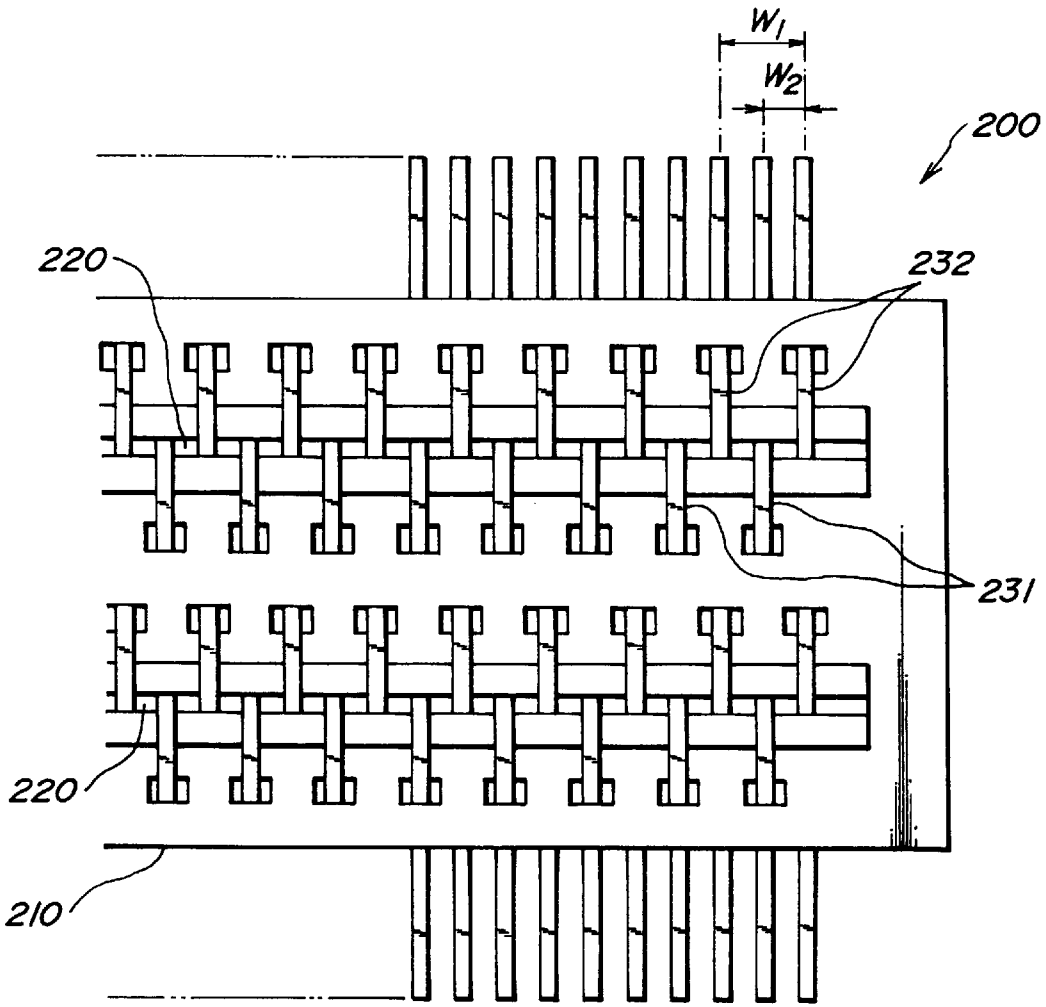
FIG. 8 is a partly enlarged view of the receptacle connector shown in FIG. 2.
Figure 9:
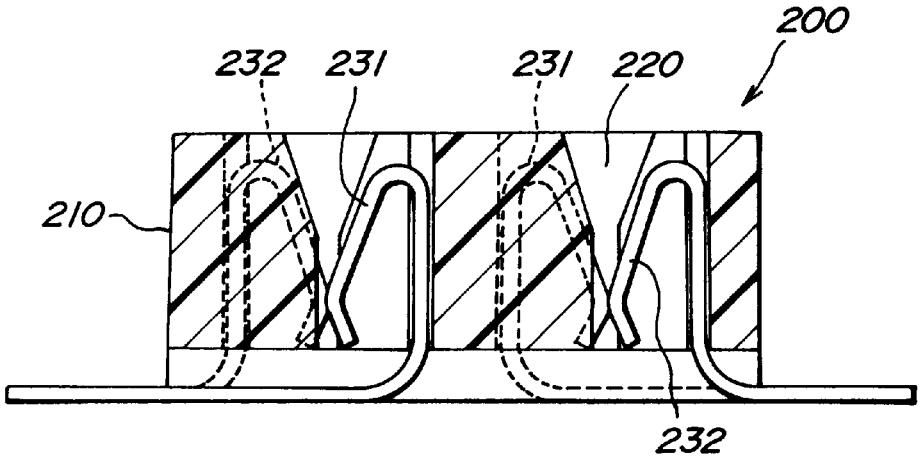
FIG. 9 is a cross-sectional view of the receptacle connector shown in FIG. 2.

Reference numeral 210 denotes a receptacle housing which is also made of an insulating material constituting the receptacle connector 200 (FIG. 8). The receptacle housing 210 is also a plastic molded body and formed with two fitting grooves 220 extending in the longitudinal direction as shown in FIGS. 8 and 9 into which are adapted to be inserted the contact portions 110*a* of the plug contacts 110. Receptacle contacts 231 and 232 made of worked elastic metal pieces are arranged alternately on both sides of the fitting grooves 220 so that the receptacle contacts 231 and 232 are adapted to contact the contact portions 110*a* of the metal contact layers 121 and 122 of the plug contacts 110 when the plug and receptacle connectors 110A and 200 are connected to each other.

Figure 10:
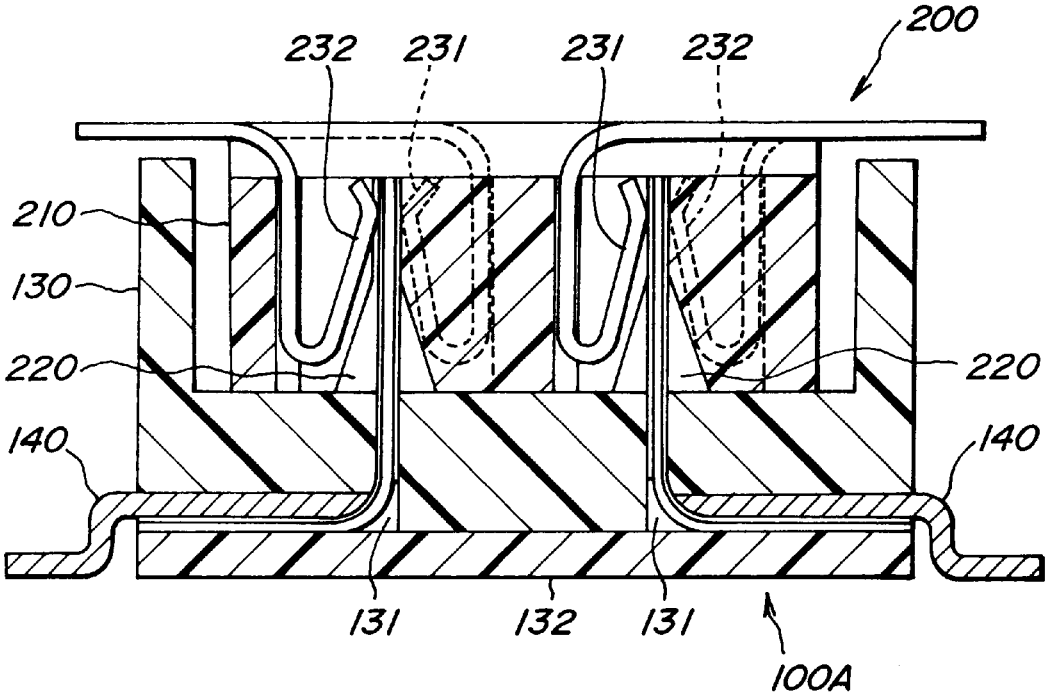
FIG. 10 is a cross-sectional view showing the fitted state of the plug and receptacle connectors of the electrical connector according to the invention.

With the thus constructed plug and receptacle connectors 110A and 200, the metal contact layers 121 and 122 of the plug contacts 110 will resiliently contact the receptacle contacts 231 and 232 to establish an electrical connection between the plug and receptacle connectors 100A and 200 when have been connected as shown in FIG. 10.

In the electrical connector including the plug connector 110A and the receptacle connector 200 according to the invention, each of the plug contacts 110 of the plug connector 100A comprises a single FPC substrate or the like to eliminate the troublesome operation for bonding FPC substrates and hence completely remove any risk of separation between bonded substrates with the lapse of time which would otherwise occur. Moreover, the flexibility of the FPC substrate will sufficiently accommodate any positional variance or shifting of the contacts in all but its longitudinal direction of the substrate.

Preferably, the metal contact layers are arranged such that the forward ends are slightly retracted from the forward end of the FPC substrate, thereby ensuring the smooth insertion of the plug connector into the mating connector and preventing the separation of the contact portion of the metal contact layers from the substrate (not shown). Moreover, the forward ends of the contact portions of the metal contact layers are preferably tapered or chamfered to obtain their smoother insertion and to prevent the separation of the forward ends from the substrate (not shown).

The contact portion 110*a* of the metal contact layer 121 has a thickness of 0.03 to 0.07 mm and its tail portion 110*c* has a thickness of 0.1 to 0.2 mm. If the contact portion 110*a* is less than 0.03 mm in thickness, the metal contact layer 121 will tend to wear off in repeated connections and disconnections of the plug and receptacle connectors resulting in incomplete electrical connection. If the contact portion 110*a* is more than 0.07 mm, the plug contact 110 will reduce its flexibility, making it impossible to accommodate the positional variance or shifting between the connectors and often causing the contacts to be damaged resulting into failure in electrical connection. On the other hand, if the tail portion 110*c* is less than 0.1 mm in thickness, it will be likely to deform when the tail portion is being connected to a board or the like, causing the failure in electrical connection. If the tail portion 110*c* is more than 0.2 mm in thickness, the metal contact layer 121 will become poorer in workability.

The contact portion 110*a* and tail portion 110*c* of the metal contact layer 121 may be formed as an integral member, but these portions may be separately formed and connected by means of any fixing means. In separately forming these portions 110*a* and 110*c*, they may be made of different metals, respectively, or may be made of the same metal. However, it is preferable to make these portions of different metals, in consideration of the characteristics of the contacts in use. In more detail, preferably a material having a higher electric conductivity is used for the contact portion 110*a*, while a material having a higher elastic modulus is used for the tail portion 110*c*. Examples of the higher conductive materials include copper, copper containing tin, and the like, and examples of the higher elastic modulus materials include beryllium bronze, phosphor bronze and the like.

There are the following methods for connecting the contact portion 110*a* and the tail portion 110*c*.

(1) These portions 110*a* and 110*c* are connected by a conductor or conductors whose ends are connected to these portions by welding to establish the electrical connection.

(2) Parts of these portions 110*a* and 110*c* are overlapped, and the overlapped portions are fastened by soldering to establish the electrical connection.

(3) Parts of these portions 110*a* and 110*c* are overlapped, and the overlapped portions are fastened by welding to establish the electrical connection.

Figure 5:
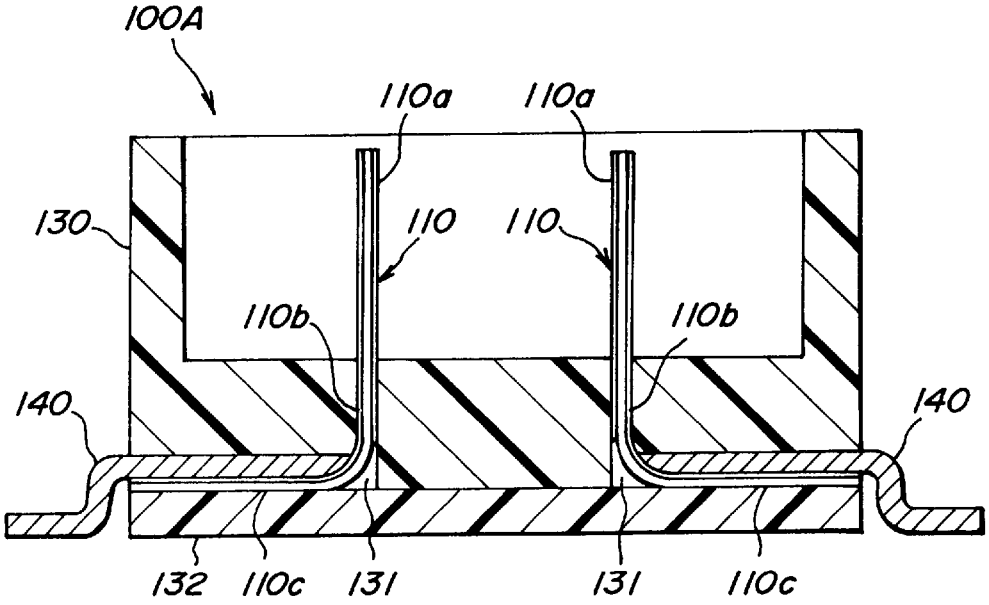
FIG. 5 is a cross-sectional view of a modification of the plug connector shown in FIG. 1.

As described above, the contact portion 110*a* and the tail portion 110*c* may be separately formed. As an alternative, to replace the difference in thickness between the tail portion 110*c* and the contact portion 110*a*, a separate member may be provided which is attached to the tail portion 110*c* as shown in FIG. 5. In other words, the tail portion 110*c* achieves its required thickness with the aid of the separate member. The tail portion 110*c* is provided with a terminal of a worked metal piece adapted to be connected to a board or the like.

This worked metal piece terminal may be made of a metal either the same as or different from the metal of the tail portion 110*c*. However, the terminal is preferably made of a metal different from that of the tail portion for the reason in the metals of the contact and tail portions 110*a* and 110*c* described above. The worked metal piece terminal is fixed to the tail portion 110*a* in the same manner as those (1), (2) and (3) for connecting the contact and tail portions 110*a* and 110*c* described above.

In case of the contact and tail portions 110*a* and 110*c* fixed by soldering or welding described above, the connected portions therebetween may be preferably covered by a molded resin in order to reinforce the connected portions in consideration of the load acting thereupon when the contacts are being press-fitted into the plug housing. Any kinds of moldable resins may be used so long as they are capable of reinforcing the connected portions, which include polybutylene terephthalate (PBT), polyamide (PA), polyethylene terephthalate (PET), liquid crystal polymer (LCP) and the like.

As in the illustrated embodiment, the substrate of the plug contact 110 having the L-shaped cross-section means that the applicable electrical connector is the surface mounting type (SMT) or L-shaped dip type. If the plug contacts 110, that is, the FPC substrate and the metal contact layers 121 and 122 are formed to have an I-shaped or crank-shaped cross-section (not shown), they can be used in an electrical connector of straight dip type. In other words, the present invention is applicable to all the types of connectors (SMT, straight dip and L-shaped dip types). With the contacts having the I-shaped or crank-shaped cross-section, the various modifications may be applied to these contacts, such as the contact and tail portions 110*a* and 110*c* being separately formed.

Figure 1:
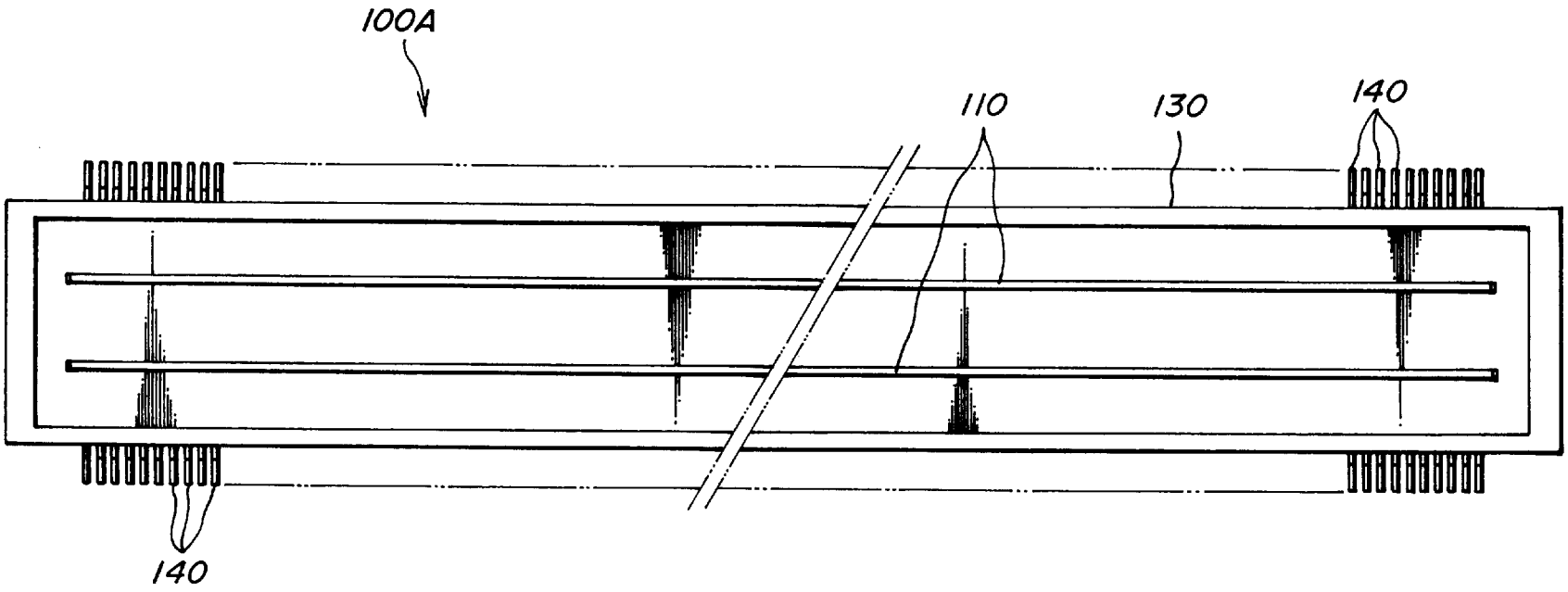
FIG. 1 is a plan view of the plug connector of the electrical connector according to the first embodiment of the invention.
Figure 2:
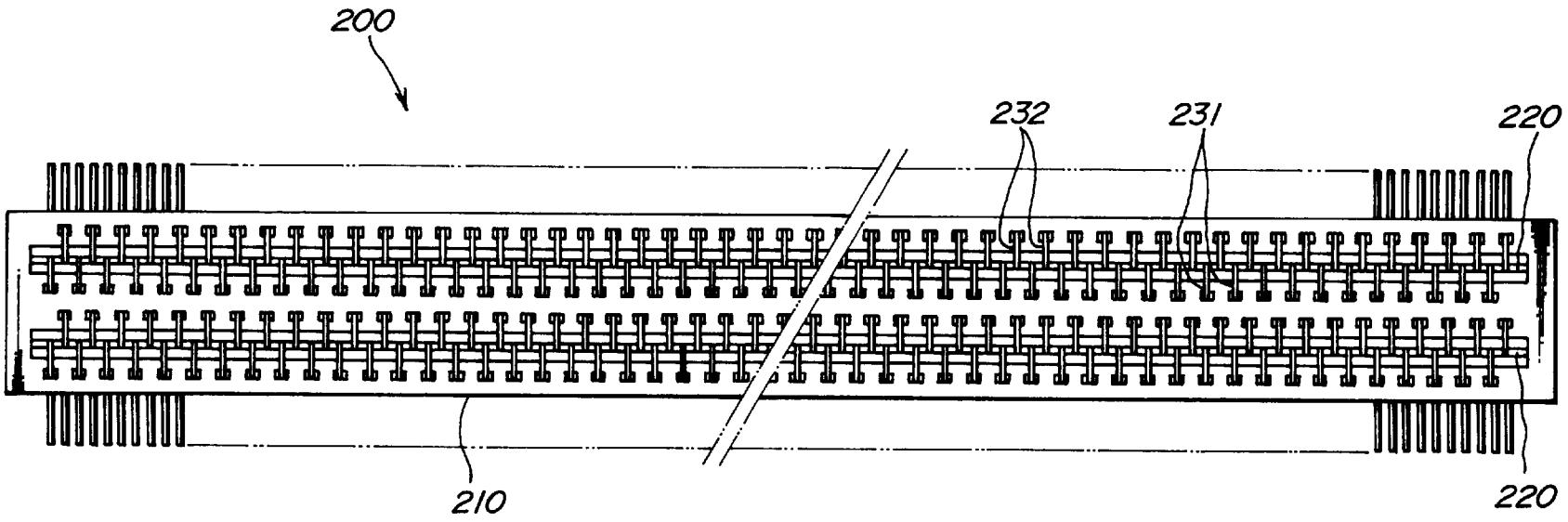
FIG. 2 is a plan view of the receptacle connector of the electrical connector according to the first embodiment of the invention.
Figure 3:
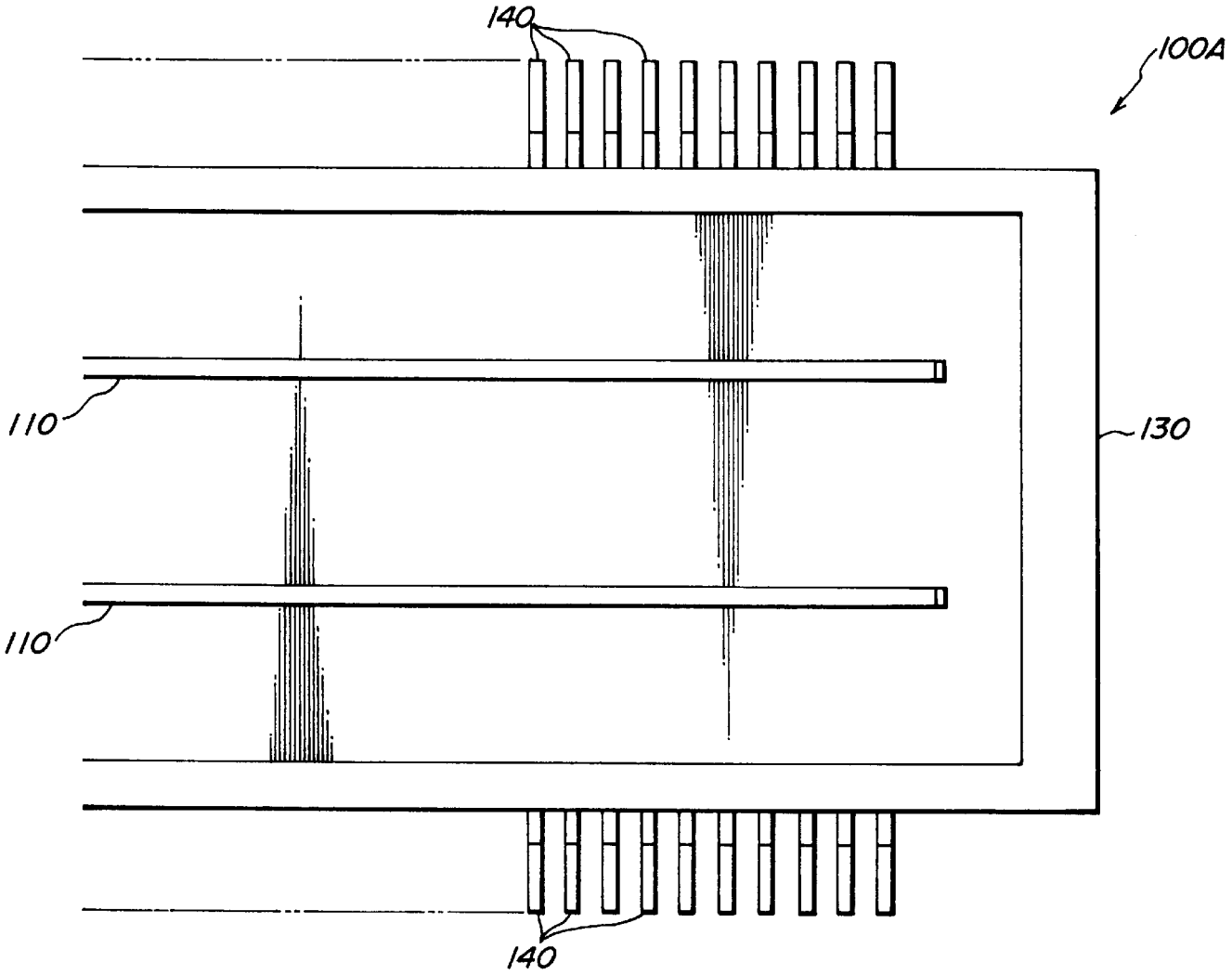
FIG. 3 is a partly enlarged view of the plug connector shown in FIG. 1.

As shown in FIGS. 2, 6 and 7, the metal contact layers 121 are arranged on one side of the substrate in a row in the longitudinal direction of the substrate and equally spaced one another, while in the same manner the metal contact layers 122 are arranged on the other side of the substrate in a row in the longitudinal direction of the substrate and equally spaced one another, so that the metal contact layers 121 arranged on one side of the substrate are located between the two adjacent metal contact layers 122 arranged on the other side. In other words, the metal contact layers 121 and 122 are arranged alternately on both the sides of the substrate in the same pitch. Such an alternate arrangement of the metal contact layers 121 and 122 on both the sides makes it possible to arrange these contact layers in a smaller pitch in comparison with the total number of the contact layers.

With the metal contact layers 121 and 122 arranged alternately on both the sides of the substrate, each of the metal contact layers 122 arranged on the other side of the substrate is connected with its lower end through the metal layer formed by plating on the inside of a through-hole 122*a* of the metal contact layer 122 to a metal contact layer 122*b* arranged on the one side of the substrate (FIGS. 6 and 7).

Correspondingly to the metal contact layers of the plug connector, contacts 231 of the receptacle connector 200 are also arranged on one side of a fitting groove 220 of the receptacle connector 200 in a row in the pitch and the remaining contacts 232 are arranged on the other side of the fitting groove 220 in a row in the pitch so that the contacts 231 arranged on the one side of the fitting groove 220 are located between two adjacent contacts 232 arranged on the other side (FIG. 8). In other words, the contacts 231 and 232 are arranged alternately on both the sides of the fitting groove 220 of the receptacle connector 200.

As described above, the great number of metal contact layers 121 and 122 are alternately arranged on both the sides of the substrate in its longitudinal direction as shown in FIGS. 6 and 7, while correspondingly the receptacle contacts 231 and 232 are also alternately arranged on the fitting groove 220 of the receptacle connector 200. Therefore, even if the metal contact layers 121 and 122 of the plug contacts 110 and the receptacle contacts 231 and 232 are somewhat erroneously shifted from their correct positions, a good electrical connection will be obtained without any trouble.

As shown in FIGS. 6 and 7, in case that the spaced distances W1 between the centers of the metal contact layers 121 on one side of the substrate and between the centers of the metal contact layers 122 on the other side are, for example, 0.8 mm, the spaced distances W2 between the centers of all the metal contact layers 121 and 122 arranged alternately on both the sides of the substrate will be approximately 0.4 mm which is half of W1. It is of course that correspondingly thereto, the spaced distances between the centers of the receptacle contacts 231 on one side of the fitting groove 220 and between the centers of the receptacle contacts 232 on the other side of the fitting groove 220 are also 0.8 mm=W1, and the spaced distance between the centers of all the receptacle contacts 231 and 232 arranged alternately on both the sides of the fitting groove 220 are also approximately 0.4 mm=W2.

In other words, although the spaced distances between all the metal contact layers 121 and 122 on both the sides of the substrate and between all the receptacle contacts 231 and 232 on both the sides of the fitting groove 220 are approximately 0.4 mm which is very small, the spaced distances between the metal contact layers 121 or 122 on one side of the substrate and between the receptacle contacts 231 or 232 on one side of the fitting groove 220 are approximately 0.8 mm which is substantially twice 0.4 mm.

Therefore, in comparison with the narrow spaced distances between all the metal contact layers 121 and 122 on both the sides of the substrate and between all the receptacle contacts 231 and 232 on both the sides of the fitting groove, the spaced distances between the metal contact layers or receptacle contacts on one side will be twice the above narrow spaced distances to create an allowance for the spacing of the metal contact layers and receptacle contacts. With this arrangement, it is possible to accommodate a positional variance or shifting of the order of 0.2 mm of the contact layers or receptacle contacts in the longitudinal direction of the housings. Namely, the positional variance or shifting of the metal contact layers and receptacle contacts even in the longitudinal direction can be effectively accommodated according to the invention.

As described above, according to the invention the spaced distances W1 between the metal contact layers on one side and between the receptacle contacts on one side are about twice the pitches of all the layers and all the contacts on both the sides. Particularly, even in case of the receptacle contacts whose contact portions formed by bent parts of worked elastic metal pieces on both the sides are arranged such that the bent parts of the pieces arranged on one side of the fitting groove 220 extend into the interspaces between the bent parts of the pieces arranged on the other side of the fitting groove as shown in FIGS. 2 and 8, owing to the effective spacing according to the invention as described above any risk of inadvertent contact between the bent parts can be eliminated which would otherwise occur in conventional closely arranged contacts. Therefore, the electrical connector according to the invention can be sufficiently useful for use with high-frequency signals with high reliability.

Figure 11:
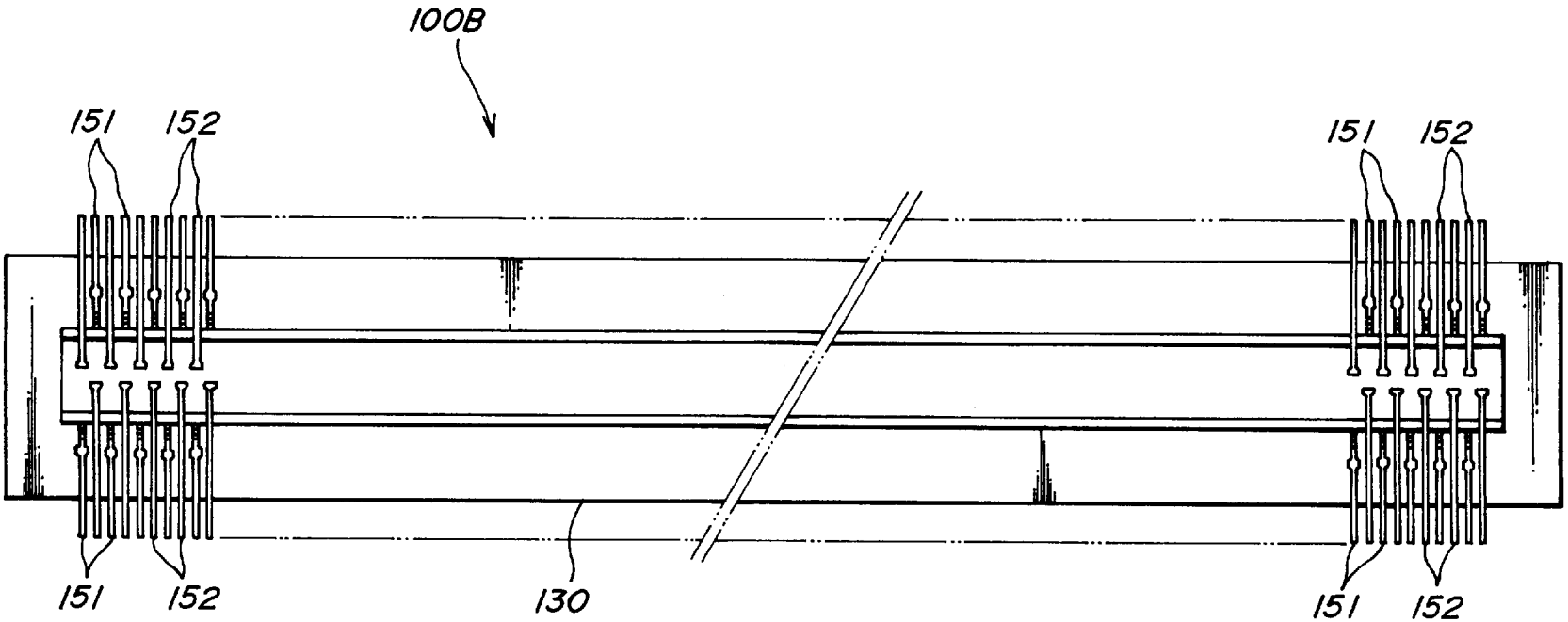
FIG. 11 is a bottom plan view of the plug connector of the electrical connector according to another embodiment of the invention.
Figure 12:
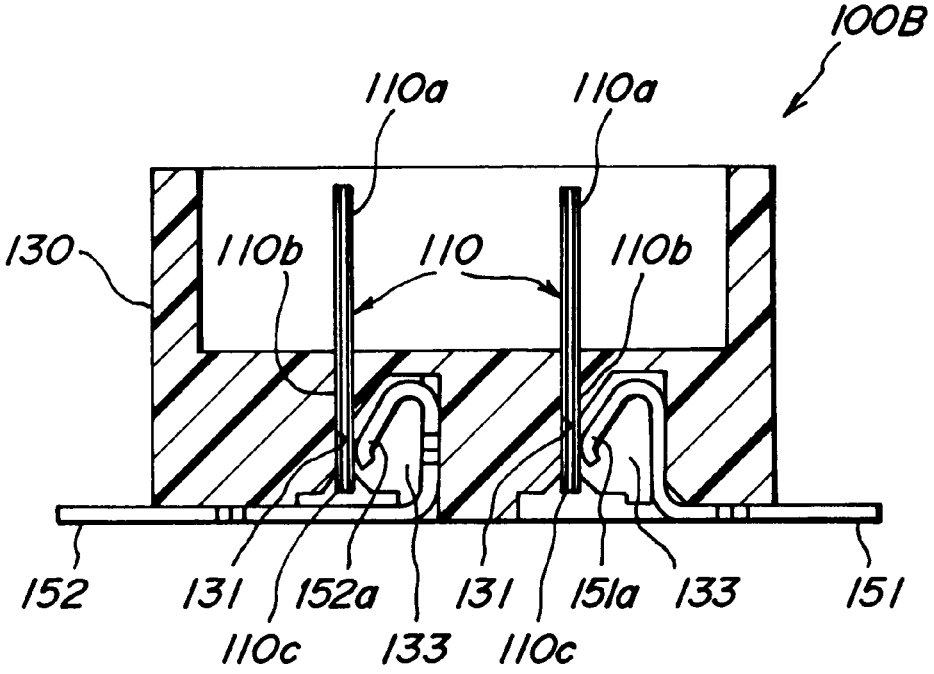
FIG. 12 is a cross-sectional view of the plug connector shown in FIG. 11.
Figure 13:
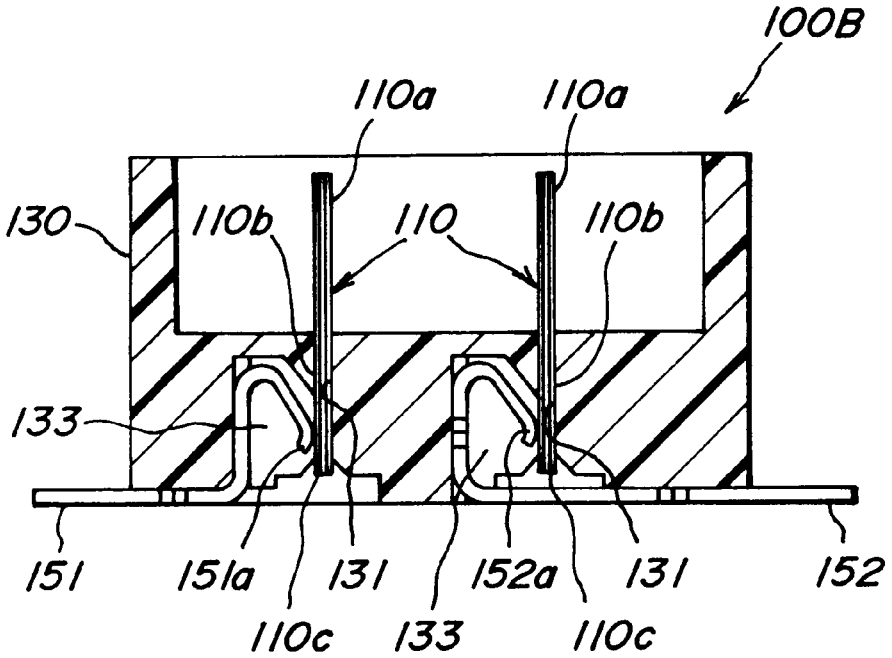
FIG. 13 is a cross-sectional view of the plug connector shown in FIG. 11 taken along another line; and, FIG. 14 is a partly exploded perspective view of the receptacle connector mating with the plug connector shown in FIG. 11.

FIGS. 11 to 13 illustrate another embodiment of the electrical connector according to the invention. The plug connector 100B in this embodiment is essentially similar in construction to the plug connector 100A of the previous embodiment, with the exception of the shape of plug contacts 110 and the connection of their tail portions 110*c* to a board of an electronic appliance.

This plug connector 100B includes plug contacts 110 each of which comprises a number of metal contact layers 121 and 122 formed on a single FPC substrate having a substantially I-shaped cross-section and being somewhat flexible. Each of the metal contact layers 121 and 122 is made of a copper foil and comprises a contact portion 110*a* and a tail portion 110*c*. The metal contact layers 121 are arranged in a pitch in a row in the longitudinal direction of the substrate on one side thereof, and the metal contact layers 122 are arranged in the same pitch in a row in the longitudinal direction on the other side of the substrate so that the metal contact layers 121 and 122 are alternately arranged on both the sides of the substrate in one half of the pitch in the longitudinal direction. This arrangement of the metal contact layers is quite the same as in the previous embodiment.

With the two plug contacts 110 of this embodiment, their vertical portions inserted in the plug housing 130 are fixing portions 110*b*. As shown in FIGS. 12 and 13, two kinds of tail terminals 151 and 152 made of worked elastic metal pieces are received in cavities 133 formed in the bottom of the plug housing 130 so that the elastic tip ends 151*a* and 152*a* of the tail terminals 151 and 152 are adapted to contact resiliently to the tail portions 110*c* of the metal contact layers 121 and 122 (not shown) of the plug contacts 100. In this case, the plug contacts include a support 110*b* molded integral with the plug contacts with a resin to fix the plug contacts 110 to the plug housing 130.

The plug connector 100B in this embodiment is fitted with the receptacle connector 200 in the same manner as in the previous embodiment, so that the metal contact layers 121 and 122 (not shown) of the plug contacts 110 resiliently contact the receptacle contacts 231 and 232 to establish an electrical connection therebetween.

The plug connector 100B has significant advantages in that the tail portions 100*c* and the tail terminals 151 and 152 are connected only by the resilient contact without using soldering or welding, so that the production of the connectors is simplified and there is no longer any risk of solder melting away even if the soldering is repeated according to the reflow soldering method for connecting the plug connector 100B to an electronic appliance.

Figure 14:
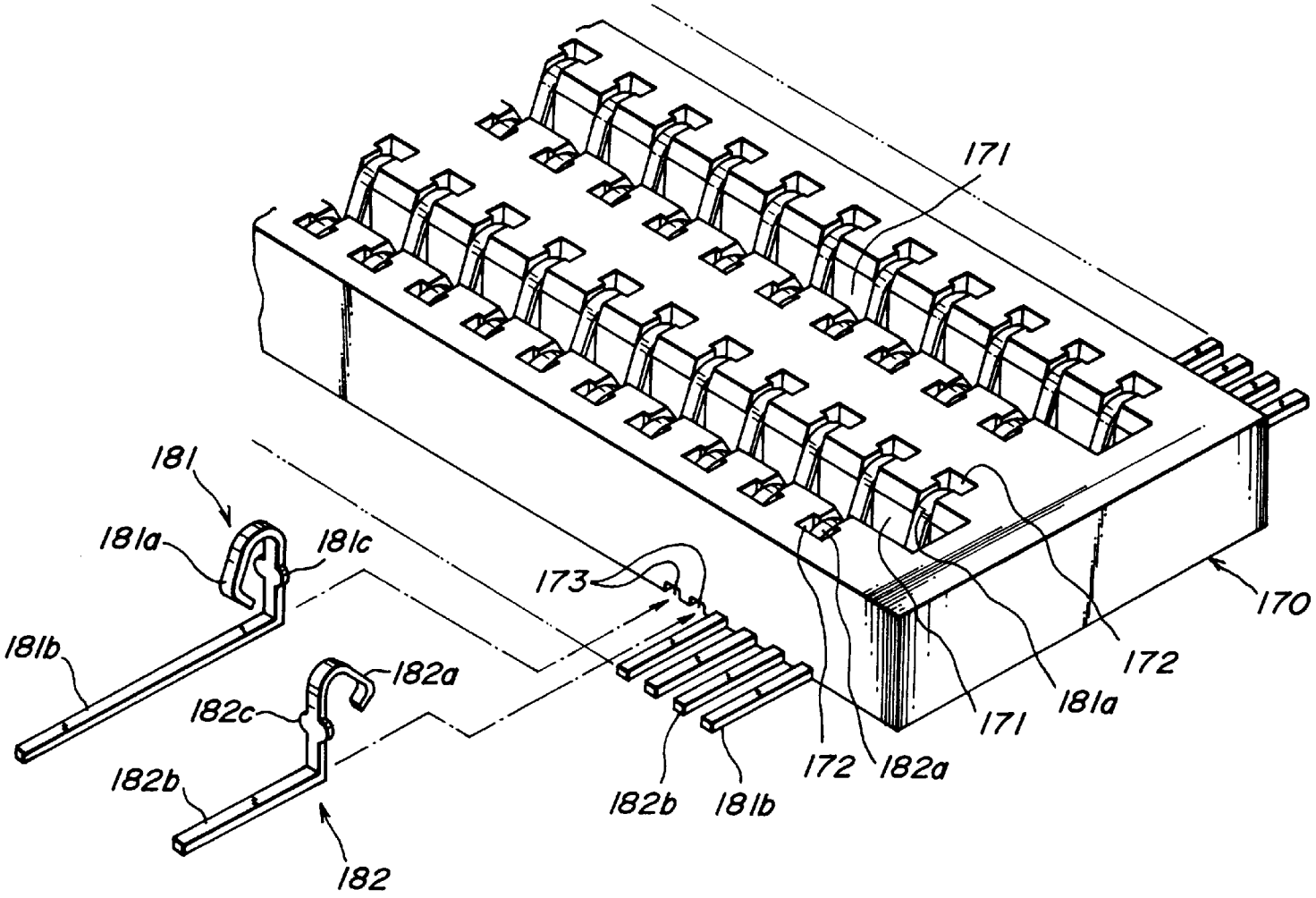

Referring to FIG. 14 illustrating the receptacle connector in detail, the receptacle housing 170 is formed with two fitting grooves 220 in the shown embodiment. A number of contact receiving portions 172 extending through the receptacle housing 170 from its bottom to the upper surface are formed on both the sides of the fitting grooves 220 such that the contact receiving portions 172 arranged on one side of the fitting groove 220 in a row are located between the contact receiving portions 172 similarly arranged on the other side of the groove 220. The two kinds of the receptacle contacts 181 and 182 are press-fitted in these contact receiving portions 172, respectively, so that the elastic tip ends 181 a and 182*a* of the receptacle contacts 181 and 182 are directed alternately in opposite directions on both sides of the grooves, and the tail terminal portions 181*b* and 182*b* of the receptacle contacts 181 and 182 extend out of the housing 170 through extending grooves 173 formed in the receptacle housing 170. In order to increase the holding force for holding the receptacle contacts 181 and 182 press-fitted in the housing 170, the vertical portions of the tail terminal portions 181*b* and 182*b* are preferably formed with enlarged anchoring portions 181*c* and 182*c*, for example, in the form of nails, respectively.

While the invention has been particularly shown and described with reference to preferred embodiments thereof, it will be understood by those skilled in the art that the foregoing and other changes in form and details can be made therein without departing from the spirit and scope of the invention. For example, although the two plug contacts 110 are shown in parallel with each other, it will be apparent that there may be provided a single plug contact or more than two plug contacts.

What is claimed is:

1. An electrical connector including a plug connector and a receptacle connector to be fitted with each other, said plug connector comprising plug contacts formed on a flexible insulating plate, and a plug housing of an insulator for holding and fixing said plug contacts, each of said plug contacts comprising a contact portion provided on the side of the forward end of said insulating plate to be brought into contact with a receptacle contact of a said receptacle connector, a fixing portion fixed to said plug housing, and a tail portion provided on the side of a fixing portion of said insulating plate to be connected to a board, said receptacle connector comprising a receptacle housing of an insulator having a fitting groove into which the contact portions of the plug contacts are inserted, and said receptacle contacts made of worked elastic metal pieces mounted in said fitting groove to be brought into contact with said contact portions of said plug contacts, and each of the contact portions of said plug contacts being formed by a thin metal layer for maintaining its flexibility and electric conductivity, and each of said tail portions of said plug contacts being formed by a metal piece thicker than its contact portion for maintaining its mechanical strength.

2. The electrical connector as set forth in claim 1, wherein the thickness of said contact portions of said plug contacts is 0.03 to 0.07 mm and the thickness of said tail portions of said plug contacts is 0.1 to 0.2 mm.

3. The electrical connector as set forth in claim 1, wherein said contact portion of the plug contact is arranged on said flexible insulating plate such that the forward end of the contact portion is slightly retracted from said forward end of said insulating plate, thereby ensuring the smooth insertion of said plug connector.

4. An electrical connector including a plug connector and a receptacle connector to be fitted with each other, said plug connector comprising plug contacts formed on a flexible insulating plate and a plug housing of an insulator for fixing said plug contact, said plug contacts comprising a number of metal contact layers arranged alternately on both the sides of said insulating plate, each of said metal contact layers having a contact portion and a tail portion, and said receptacle connector comprising a receptacle housing of an insulator having a fitting groove into which the contact portions of said plug contacts are inserted, and receptacle contacts made of worked elastic metal pieces alternately mounted on both sides of said fitting groove to be brought into contact with the contact portions of said metal contact layers of the plug connector, respectively.

5. An electrical connector including a plug connector and a receptacle connector to be fitted with each other, said plug connector comprising plug contacts formed on a flexible insulating plate, said plug contacts comprising a number of metal contact layers arranged alternately on both the sides of said insulating plate, each of said metal contact layers having a contact portion and a tail portion, a contact support formed integral with said plug contacts with a resin, a plug housing of an insulator formed with a fitting groove into which said tail portions of the plug contacts extending from said contact support are inserted, and tail terminals made of worked elastic metal pieces mounted on both sides of said fitting groove to contact the tail portions of said metal contact layers, said receptacle connector comprising a receptacle housing of an insulator having a fitting groove into which the contact portions of said plug contacts are inserted, and receptacle contacts made of worked elastic metal pieces alternately mounted on both sides of said fitting groove to be brought into contact with the contact portions of said metal contact layers of the plug connector, respectively.

* * * * *